United States Patent [19]

vonStroh, III

[11] 4,052,041

[45] Oct. 4, 1977

[54] APPARATUS FOR INJECTING GRANULAR MATERIAL INTO A MOLTEN METAL

[76] Inventor: Gerald F. H. H. vonStroh, III, 2976 Staunton Road, Huntington, W. Va. 25702

[21] Appl. No.: 750,633

[22] Filed: Dec. 15, 1976

[51] Int. Cl.[2] ..... C21C 7/00

[52] U.S. Cl. ..... 266/81; 266/217

[58] Field of Search ..... 266/216, 217, 225, 226, 266/81, 78; 302/42, 49

[56] References Cited

U.S. PATENT DOCUMENTS

| | | | |
|---|---|---|---|
| 2,806,781 | 9/1957 | Shepherd et al. | 266/216 |
| 3,063,699 | 11/1962 | Read | 266/226 |

*Primary Examiner*—Gerald A. Dost

*Attorney, Agent, or Firm*—Cushman, Darby & Cushman

[57] ABSTRACT

Apparatus for injecting a predetermined amount of a selected free flowing granular material into a body of molten metal comprising a plurality of supply hoppers for receiving a plurality of supplies of different granular materials to be injected each supply hopper having a control gate on the lower end of its outlet chute for controlling the flow of granular material within the supply hopper outwardly thereof into a receiving hopper which feeds it to an incremental volume forming position. The apparatus further includes a confined flow path for the flow of air under pressure into a granular material entraining position and for the flow of air under pressure with granular material entrained therein from the granular material entraining position to a lance for the body of molten metal, the confined flow path having valves upstream of the granular material entraining position for controlling the flow if air under pressure through the confined flow path and a power driven pocketed rotor for transferring successive incremental volumes of granular material from the incremental volume forming position to the granular material entraining position. The apparatus also includes an electric control circuit for sensing a condition indicative of the flow of a predetermined amount of granular material from the selected supply hopper and for (1) operating the control gate thereof to prevent further flow of material therefrom and (2) rendering the power driven pocketed rotor inoperable and closing the air control valve after the operation of the control gate so as to insure that all of the granular material received from the selected supply hopper prior to the operation of the control gate is fed to the incremental volume forming position, transferred to the granular material entraining position, entrained within the air under pressure flowing in the confined path and discharge therewith through the lance into the body of molten metal.

25 Claims, 8 Drawing Figures

28
30
40
42
56
58
58
48
50
116
112
60
68
84
114
62
114
64
108
70
110
110
88
86
96
90
98
91

APPARATUS FOR INJECTING GRANULAR MATERIAL INTO A MOLTEN METAL

This invention relates to an apparatus useful in the operation of electric arc, induction and open hearth furnaces and particularly to improve apparatus for injecting a free flowing granular material into a body of molten metal in such furnace.

In the operation of electric arc furnaces, as well as the operation of other types of steel making furnaces, such as induction or open hearth furnaces various materials must be added to the body of the molten metal within the furnace in order to obtain desirable characteristics in the resultant product. For example, such functions include the increase and decrease of carbon, alloy control and slag control or desulphurization.

With respect to carbon increase, about once every six heats in an electric arc furnace producing carbon steel, the "melt-in" carbon will be low. Various procedures are known for accomplishing the function of carbon increase, including dipping electrodes, ladling additional carbon and injecting free flowing granular carbon. It is generally accepted that injection is more accurate and less costly. The carbon decrease function is achieved by oxygen lancing or by injecting specially prepared $Fe_3O_4$ (see for example U.S. Pat. No. 3,749,567). Here again it is generally accepted that the injection of $Fe_3O_4$ in a free flowing granular material form is more efficient and less costly. With respect to alloy control, here again it is generally recognized that efficiency can be optimized by injecting alloys in a free flowing granular form such as nickel oxide or molybdeum oxide. With respect to slag control, injection of lime or limestone in a free flowing granular form in the body of the molten metal provides a more efficient slag control than other methods. Finally, the injection of sulphur reducing agents, again in free flowing granular form, can achieve in a most efficient manner, the desulphurization required in a given situation.

In general, the injection techniques heretofore employed have closely approximated the techniques utilized in gunite systems. Accuracy in terms of the amount of material injected was achieved on the basis of a bag count in most instances. Efforts to provide a more accurate determination of the amount injected has included the provision of a timer for the motor of the injection equipment. Arrangements of this type have not received any widespread acceptance for the reason that they required the execution of too much judgment on the part of the operator. Moreover even where a timer was used, the system was automatically shut down before all of the granular material contained in the feed hopper was used up. This resulted in the need to clean the system in the event it was to be used to inject another material. The cleaning procedure presented considerable inconvenience. Furthermore, clogging often resulted where the system was allowed to remain inactive with material in it. There exists a need in the industry for an effective system of injecting various materials as they are needed which obviate the problems heretofore encountered and provide practical operation in a manner fully acceptable to those in the industry.

An object of the present invention is the provision of an injection system of the type described which will supply the needs enumerated above. In accordance with the principles of the present invention, this object is obtained by providing apparatus which has at least one supply hopper provided with a controllable discharge opening. The apparatus also includes a receiving hopper adapted to receive the granular material from the supply hopper and to feed it to an incremental volume forming position. A power driven pocketed rotor is provided which serves to transfer successive incremental volumes of granular material from the incremental volume forming position to a granular material entraining position. The entraining position is embodied within an air flow path of a source of air under pressure which is under control of a suitable control valve which flow path extends to and through a furnace lance. Finally, the apparatus is provided with a control circuit which is capable of sensing a condition indicative of the flow of granular material outwardly of the supply hopper of the predetermined amount which is to be injected so that when this condition is sensed the discharge opening of the supply hopper is closed to prevent further flow of material therefrom. The control circuit is further operable to permit the continued operation of the pocketed rotor and air flow after the closing of the discharge outlet until all of the granular material received from the supply hopper is fed to the incremental volume forming position, transferred to the granular material entraining position, entrained within the air under pressure and discharged through the lance into the body of the molten metal. With this arrangement, the two main problems heretofore encountered are effectively overcome. Once, the only judgment which the operator need make is to set the controls so that they will function at the predetermined amount of material which is desired. Second, when the injection process has been completed, the system is automatically cleared so that there is no granular material left in the system.

Preferably, the present invention contemplates the provision of a plurality of separate supply hoppers with appropriate functions built into the control circuit for enabling the operator to simply select which of the supply hoppers is to be utilized based upon the material contained in the selected supply hopper.

Preferably, the sensing means of the control circuit constitutes a known counter which is rendered operable to count the number of pockets in the pocketed rotor which are filled with granular material and emptied into the flow of air under pressure. It is also preferable that the control circuit embody a time delay arrangment capable of insuring that the air flow will commence before the rotation of the pocketed rotor and that the rotation of the pocketed rotor will be stopped prior to the closing of the air circuit. This time delay arrangement insures that the air circuit is available before any granular material is introduced therein and that any material introduced into the air circuit will be fully conveyed outwardly thereof before the air circuit is closed.

Preferably, the apparatus is such as to enable the operator to handle, as by overhead cranes, the supply hopper or hoppers separately from the remainder of the apparatus, such function being achieved by providing for a telescopic type frame which is capable of supporting the supply hoppers for upward movement by the crane.

Another object of the present invention is the provision of the apparatus of the type described which is simple in construction, effective in operation and economical to manufacture and maintain.

These and other objects will become more apparent during the following detailed description taken in conjunction with the accompanying drawings and appended claims.

IN THE DRAWINGS

Figure 1:
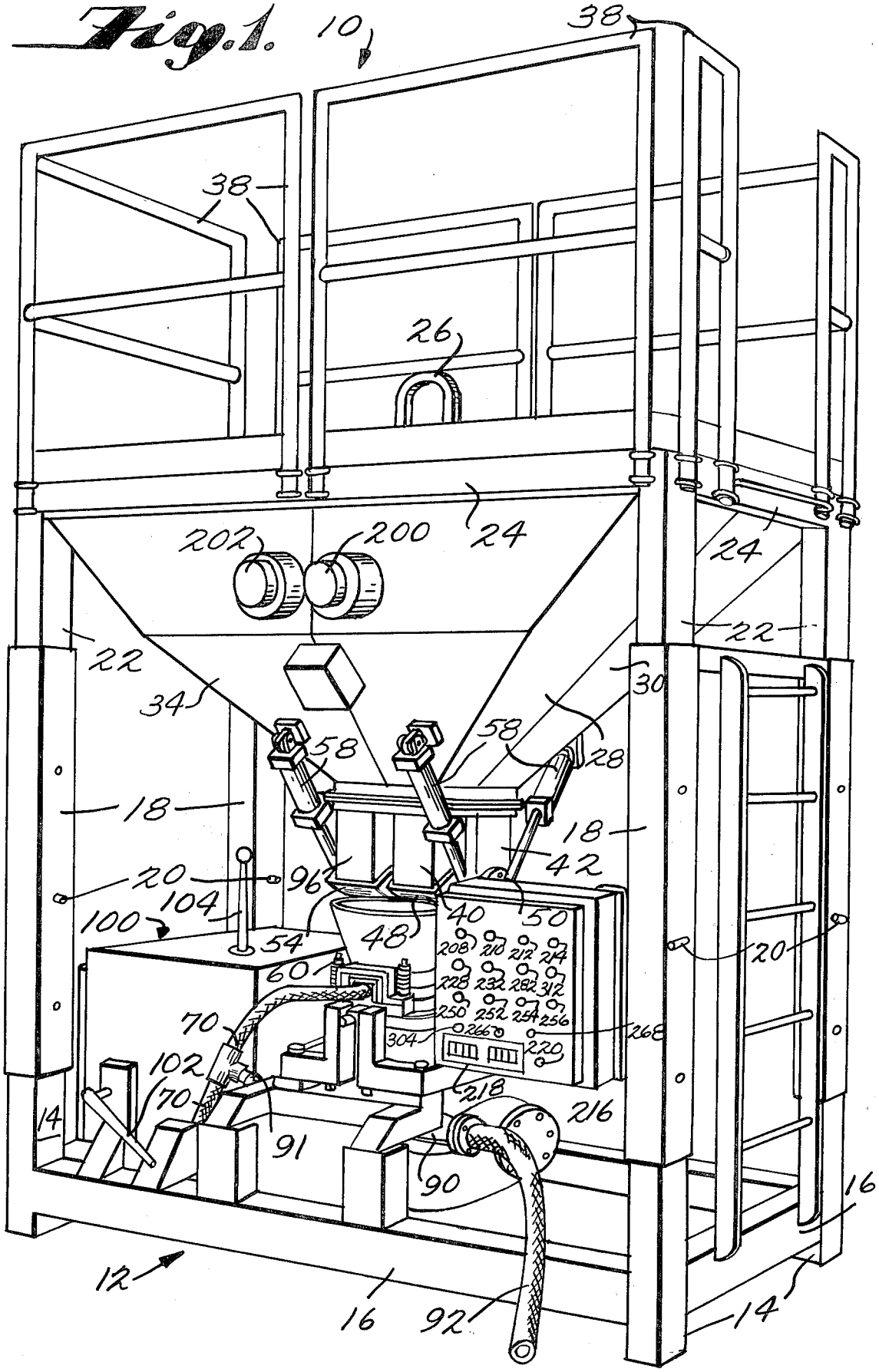
FIG. 1 is a perspective view of a unit supporting the components of an apparatus embodying the principles of the present invention except for the portable lance assembly component.

Referring now more particularly to FIG. 1 of the drawings, there is shown therein a stationary unit, generally indicated at 10, which embodies several components of the apparatus of the present invention. The unit 10 includes a frame structure, generally indicated at 12 which as shown, includes four upstanding corner leg members 14 suitable rigidly interconnected at their lower end portions by longitudinally and transversely extending base members 16. Adjustably mounted on the four leg members are four tubular members 18, the adjustment being accomplished by a series of pins 20 extending through registering openings in the tubular members and legs. The tubular members 18 extend above the upper ends of the leg members 14 and provide sockets for receiving four depending corner members 22 having their upper ends rigidly interconnected as by longitudinal and transverse peripheral frame members 24.

The unitary upper structure formed by the members 22 and 24 is thus supported telescopically by the lower base structure and tubular members 18 in an operative position, as shown in FIG. 1, and for movement therefrom upwardly, as by a conventional overhead crane or the like. To this end, there is provided a crane hook 26 which is rigidly connected to the peripheral frame members 24 so as to extend above the central portion of the upper structure.

Figure 4:
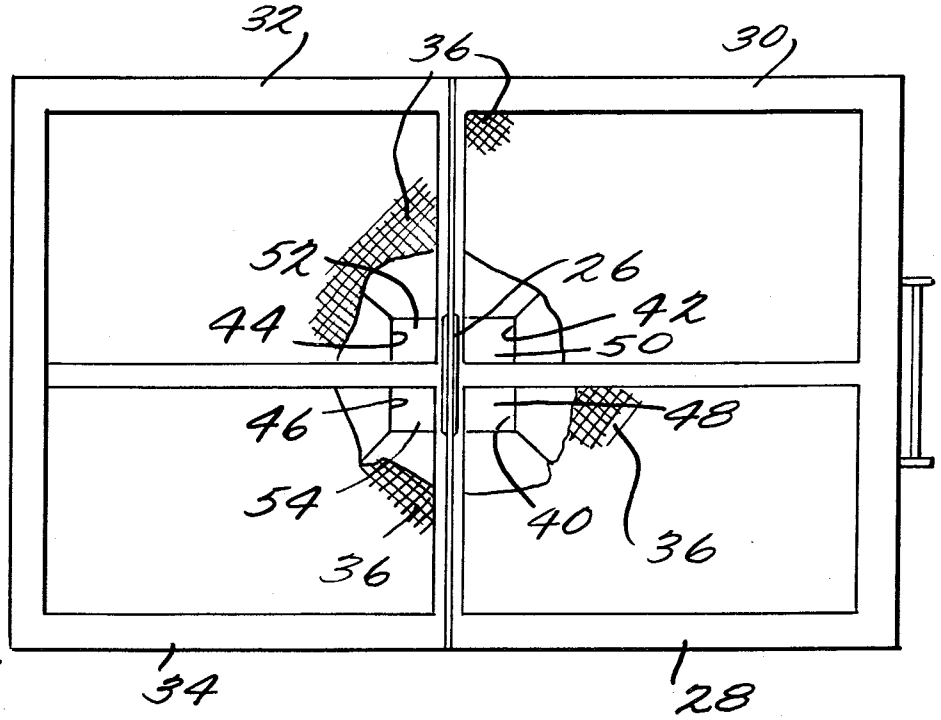
FIG. 4 is a top plan view of the unit shown in FIG. 1.

The upper structure has rigidly secured thereto supply hopper means constituting a component of the present apparatus formed as part of the unit 10. As shown, there are four supply hoppers 28, 30, 32 and 34 provided, the supply hoppers having their upper ends open and disposed within four rectangular quadrants within the upper peripheral frame members 24. The upper ends of the hoppers may be covered with expanded metal screens 36 (FIG. 4) and it will be noted from FIG. 1 that hand railings 38 are detachably mounted around the peripheral frame members 24 in upwardly extending relation. The hand railings 38 and screens 36 provide a convenient means by which an operator can fill the hoppers with different materials from suitable bags. It will be understood that one or more bag openers and/or box openers (not shown) may be provided at the upper level in conjunction with the screens and hand rails.

The supply hoppers are configured so that their walls slope inwardly and downwardly and terminate in discharge outlet chutes 40, 42, 44 and 46 which are centrally positioned with respect to the peripheral frame members 24. The discharge chutes are provided with control gates 48, 50, 52 and 54 respectively which are operable to control the flow of material from the respective supply hopper outwardly through the associated discharge chute opening. As shown, each discharge chute is of square or rectangular cross-sectional configuration and the end walls of each chute have their lower edges formed into an arcuate configuration. Each control gate is of generally U-shaped configuration, the bight portion of which is in the form of an arcuate wall adapted to engage the arcuate lower edges of the end walls of the associated discharge chute. The legs of each gate extend upwardly adjacent the end walls of the associated chute and are pivotally connected thereto, as by an appropriate pivotpin 56, for pivotal movement about an axis concentric with the axis of curvature of the arcuate end surfaces of the end walls and the arcuate curvature of the bight portion of U-shaped control gate. Each control gate 48, 50, 52 and 54 is thus pivotally mounted at the lower end of its respective discharge chute 40, 42, 44 and 46 for movement between a closed position, as shown in the drawings, wherein the arcuate wall of the gate blocks the lower edges of the discharge chute and an open position wherein the gate is displaced arcuately outwardly from beneath the edges of the discharge chute. As shown, a piston and cylinder unit 58 is associated with each gate for effecting the pivotal movement thereof from between its opened and closed positions.

Figure 3:
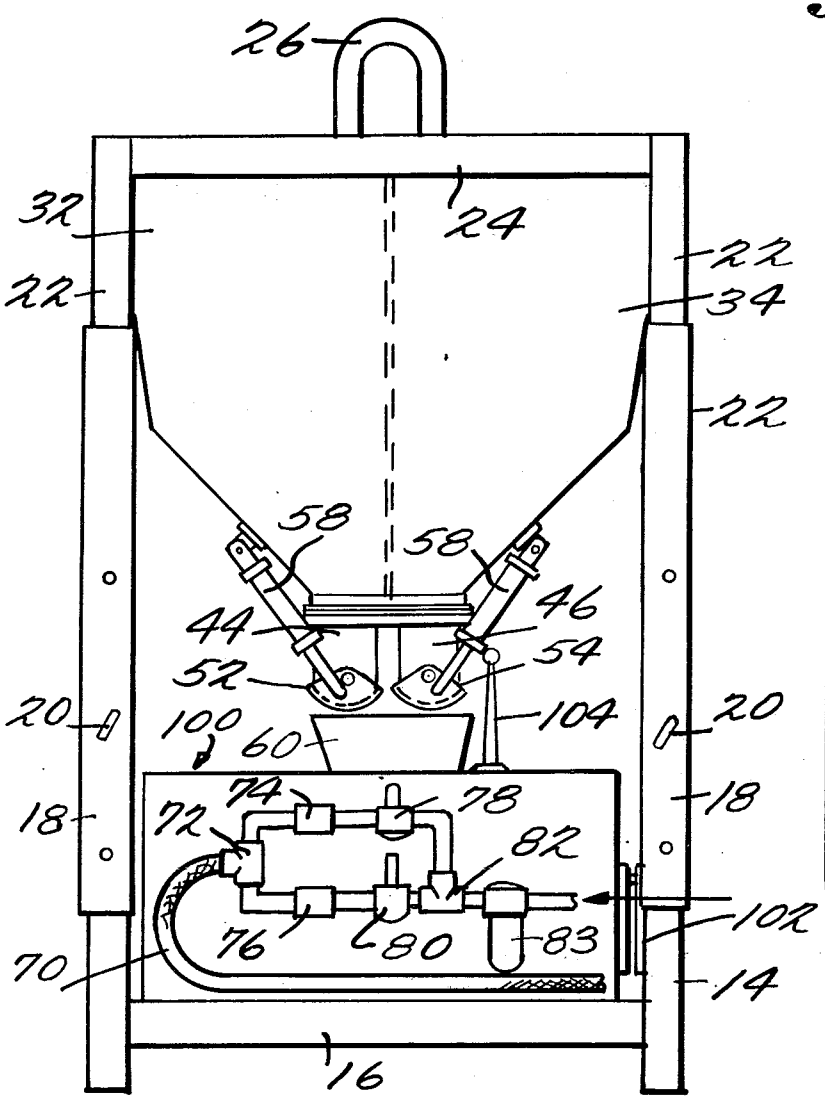
FIG. 3 is a side elevational view of the unit shown in FIG. 1.
Figure 5:
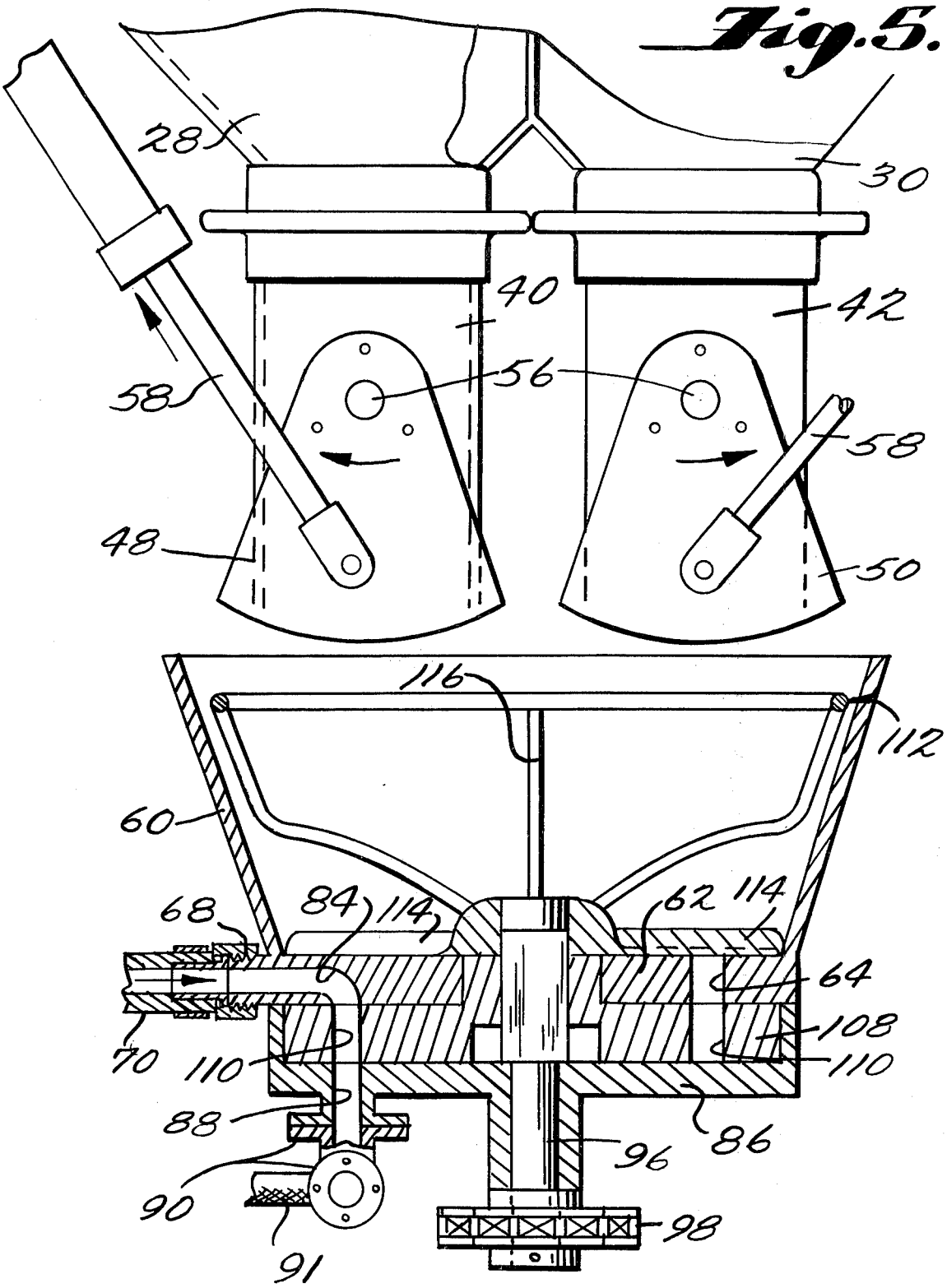
FIG. 5 is a somewhat schematic vertical sectional view of certain components of the unit shown in FIG. 1.

Disposed below the discharge chutes 40, 42, 44 and 46 is a receiving hopper 60. As best shown in FIG. 5, the receiving hopper 60 is provided with a bottom wall 62 having a discharge opening 64 extending therethrough which defines an incremental volume forming position within the hopper. The bottom wall 62 has a fitting 68 formed in the periphery thereof, which fitting receives one end of a conduit 70 forming a part of an air under pressure flow circuit. As best shown in FIG. 3, the upstream end of the conduit 70 is a T-fitting 72 the ends of which are connected with solenoid control valves 74 and 76. The valves 74 and 76 are respectively connected to a pair of pressure regulators 78 and 80 which in turn are connected to a T-fitting 82. It is important that the air source be free of all contained water. Consequently, as shown there is provided downstream of the T-fitting 82 a filter 83. The filter 83 is of any conventional construction a preferred embodiment being Norgren Air Filter No. 12-063-004. The stem of the T-fitting 82 is connected with a suitable source of air under pressure (not shown). It is contemplated that a source of air under pressure is available in most installations where the unit 10 is to be utilized. However, it is within the contemplation of the present invenion to provide a compressor as part of the unit 10. As schematically illustrated in FIG. 3, the arrangement as shown is suitable to provide for a connection to factory air provided by the user.

It can be seen that the source flows through T-fitting 82 either through pressure regulator 78, valve 74 to the T-fitting 72 and hence through conduit 70 to the fitting 68 on the hopper wall 62, or through the parallel circuit provided by the pressure regulator 80 and valve 76. The operation of these valves and the different pressures maintained by the regulators will become more apparent hereinafter.

It will be noted by reference to FIG. 5 that the hopper bottom wall 62 provides an opening 84 for the continuation of the confined air flow path from the fitting 68 through air elbow turn to the lower surface of the hopper bottom wall. The hopper 60 and the bottom wall 62 integral therewith is carried by a rotor frame 86 which includes an outlet opening 88 spaced below the opening 84 in the lower surface of the hopper bottom plate 62 and defining therewith a granular material entraining position within the frame 86. The outlet opening 88 has a reducing T-fitting 90 connected therewith to direct the air an entrained material into one end of an elongation hose 92 forming a part of the air flow path. The fitting 90 also makes provision for additional fluidizing air as from a branch conduit 91 coming from the conduit 70. The elongated hose 92 confines the flow of air and entrained material to a discharge end which includes a lance assembly 94 of the type shown in FIG. 2.

Rotatably mounted on the rotor frame 86 is a central shaft 96 which is suitably power driven, as through a sprocketed chain 98, shown in FIG. 5 by a multiple speed motor gear reduction unit, generally indicated as 100. It will be understood that any suitable gear arrangement may be provided and as shown, the unit is a four speed assembly provided with a hand clutch 102 and a gear shaft lever 106 whereby four different speeds from a constant speed electric motor 106 may be imparted to the shaft 96.

Fixed to the shaft 96 within the rotor housing 86 and below the bottom wall 62 of the hopper 60 is a rotor 108 having a series of annularly spaced pockets 110 extending therethrough. It will be noted that the pockets 110 are positioned so as to be in alignment with the opening 64 in the bottom wall 62 at the incremental volume forming position and in alignment with the openings 84 and 88 at the material entrainment position. During the movement of the rotor 108 with the shaft 96 about the axis of rotation thereof, successive pockets 110 are moved from the incremental volume forming position where they are filled with granular material from the receiving hopper 60 to the material entraining position where they are emptied by entrainment into the air flowing in the air path from the opening 84 to the opening 88. It will also be noted that the shaft 96 extends through the rotor 110 upwardly beyond the central opening in the bottom wall 62 of the receiving hopper 60 and has connected therewith an agitating or stirring structure generally indicated at 112.

The stirring structure 112 includes lower blades 114 which scrape the upper surface of the bottom wall 62 and serve to insure the granular material received in the hopper 60 is fed to the incremental volume forming position defined by opening 64. The upper portion of the stirring structure is of skeletal rod formation, as indicated at 116, and serves to prevent granular material from bridging in the upper portion of the hopper 60. It will also be understood that the rotor housing 86 has a vent opening (not shown) formed therein in a position to be communicated with the pockets 110 between the entrainment position and the incremental volume forming position in the direction of rotation. This insures that any air pressure which is captured in a pocket 110, as the pocket is moved in communication with the openings 84 and 88 will be subsequently vented to atmosphere before it reaches the opening 64 so that the pocket is in a condition to readily receive the granular material at the incremental volume forming position.

Figure 2:
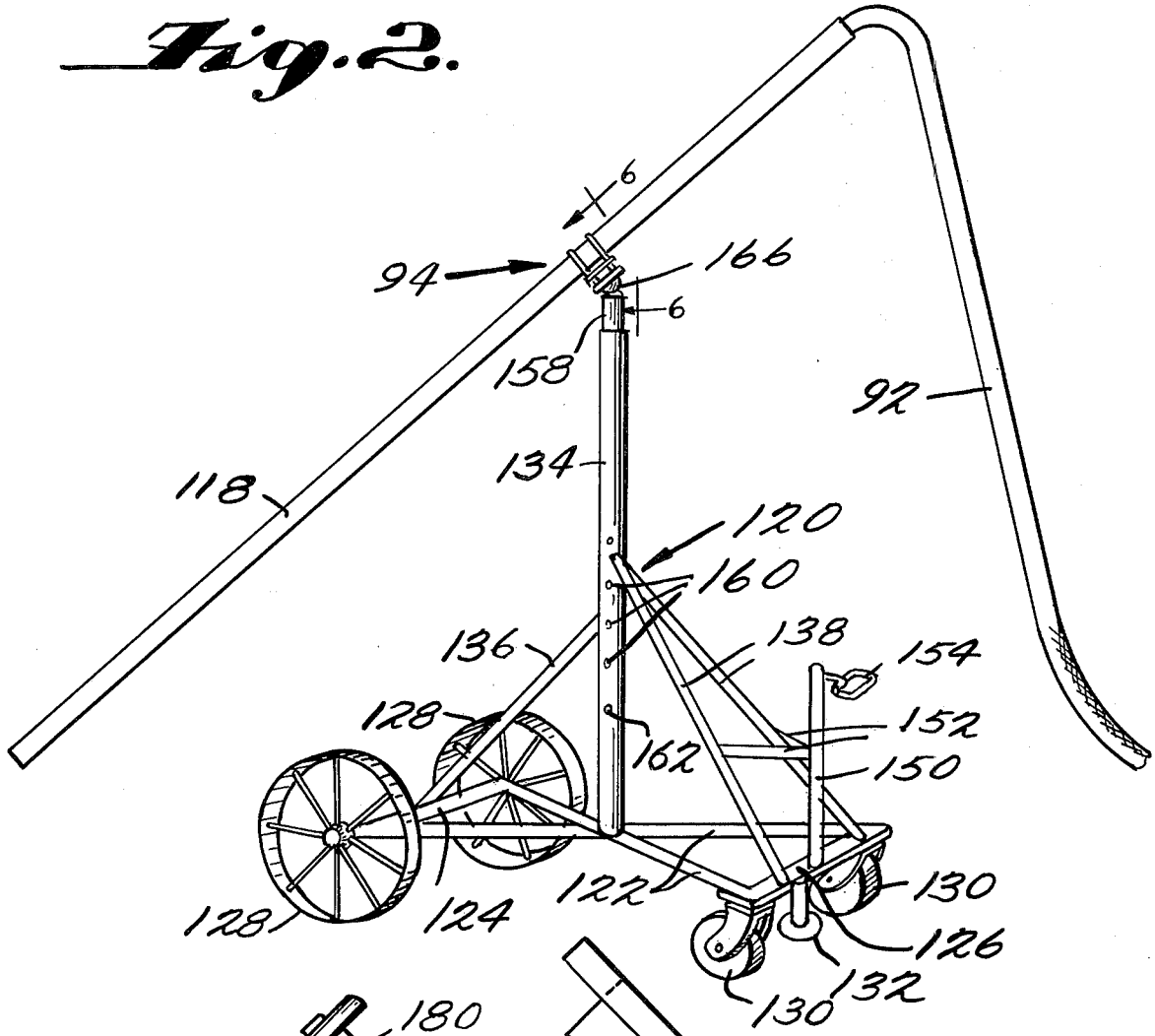
FIG. 2 is a perspective view of a portable lance assembly forming a component of the apparatus of the present invention.

Referring now more particularly to FIG. 2, the lance assembly 94 shown therein includes a lance 118 connected at one end to the associated end of the elongated hose 92. The assembly 94 also includes an adjustable wheel carriage, generally indicated at 120, for adjustably supporting and moving the lance 118 into operative relation with the body of molten metal within the furnace to be injected. As shown, the carriage 120 includes a frame structure made up of a pair of main horizontally extending frame members 122 arranged in X-shape. Adjacent ends of the members 122 are interconnected by a pair of transversely extending tubular frame members 124 and 126. Rotatably mounted on the ends of the tubular member 124 are wheels 128. The other tubular member 126 has a caster wheel assembly 130 suitably mounted beneath each end thereof. Mounted on the tubular member 126 between the caster wheels is a floor lock assembly 132 of a well known construction operable when engaged by the foot of an operator to transfer the support of the frame from the caster wheels to the foot lock assembly which provides stability for the frame when the lance is in use within the furnace.

Fixed to the central intersecting portion of the two main frame members 122 is the lower end of an outer telescopic mounting tube 134 which extends upwardly therefrom. The upper end of the tube 134 is supported by a tubular face 136 fixed to the central portion of member 124 and a pair of downwardly diverging tubular braces 138 fixed adjacent the ends of member 126.

Fixed to the central portion of the tubular frame member 126 is the lower end of a standard 150 which extends upwardly. The upper end of the standard is braced by a pair of braces 152 extending to the associated braces 138. Fixed to the upper end of the standard 150 is a handle or hitch member 154.

Telescopically mounted within the mounting tube 134 is an inner tubular member 158. As shown, the mounting tube 134 is provided with a series of openings 160 enabling a pin 162 to be engaged through a set of registering openings to adjustably position the height of the inner tubular member 158 with respect to the mounting tube 134.

Figure 6:
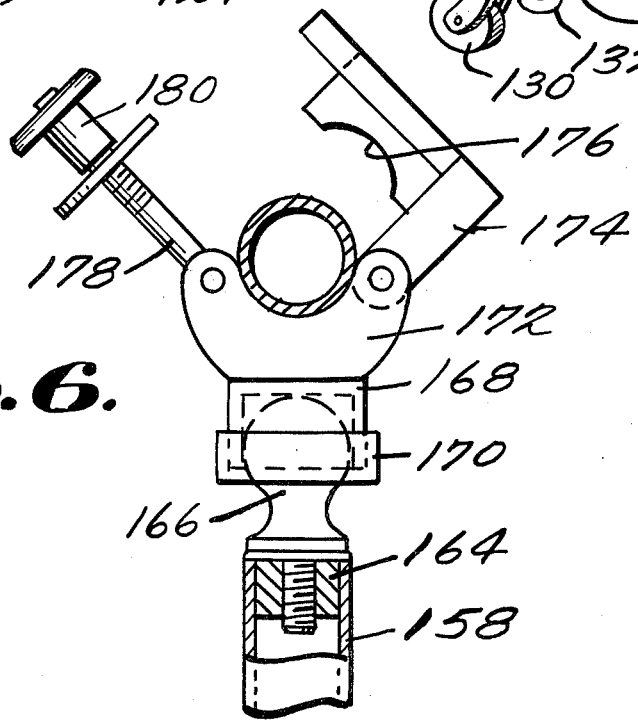
FIG. 6 is an enlarged fragmentary sectional view taken along the line 6—6 of FIG. 2, and FIGS. 7A and 7B are cooperative halves of an electrical schematic diagram of the control circuit embodied in the apparatus of the present invention.

As best shown in FIG. 6, the upper end of the inner tubular member 158 is provided with a plug 164 which is formed with a central threaded opening for receiving the threaded stem of a ball joint member 166. The ball joint member 166 fits within a socket member 168 and is secured in an adjusted position by a cooperating socket member 170. Mounted on the socket member 168 is a saddle member 172 which is shaped to receive the lower periphery of the lance 118. Pivotably mounted on one side of the saddle member 172 is a cooperating clamp element 174 having an arcuate surface 176 which is adapted to engage the upper periphery of the lance 118. A securing bolt 178 is pivoted at one end to the opposite side of the saddle member 172 and is adapted to move through an opening in the clamp element 174 so that a nut 180 on the outer end thereof can be tightened into pressure engagement with the clamp element forcing the same into pressure tight engagement with the periphery of the lance. In this way, the lance 118 is adjustably carried by the clamp both for longitudinal and rotational movement with respect thereto while the ball joint connection provides for angular adjustment of the axis of the lance in any suitable angle with respect to the horizontal.

Figure 7A:
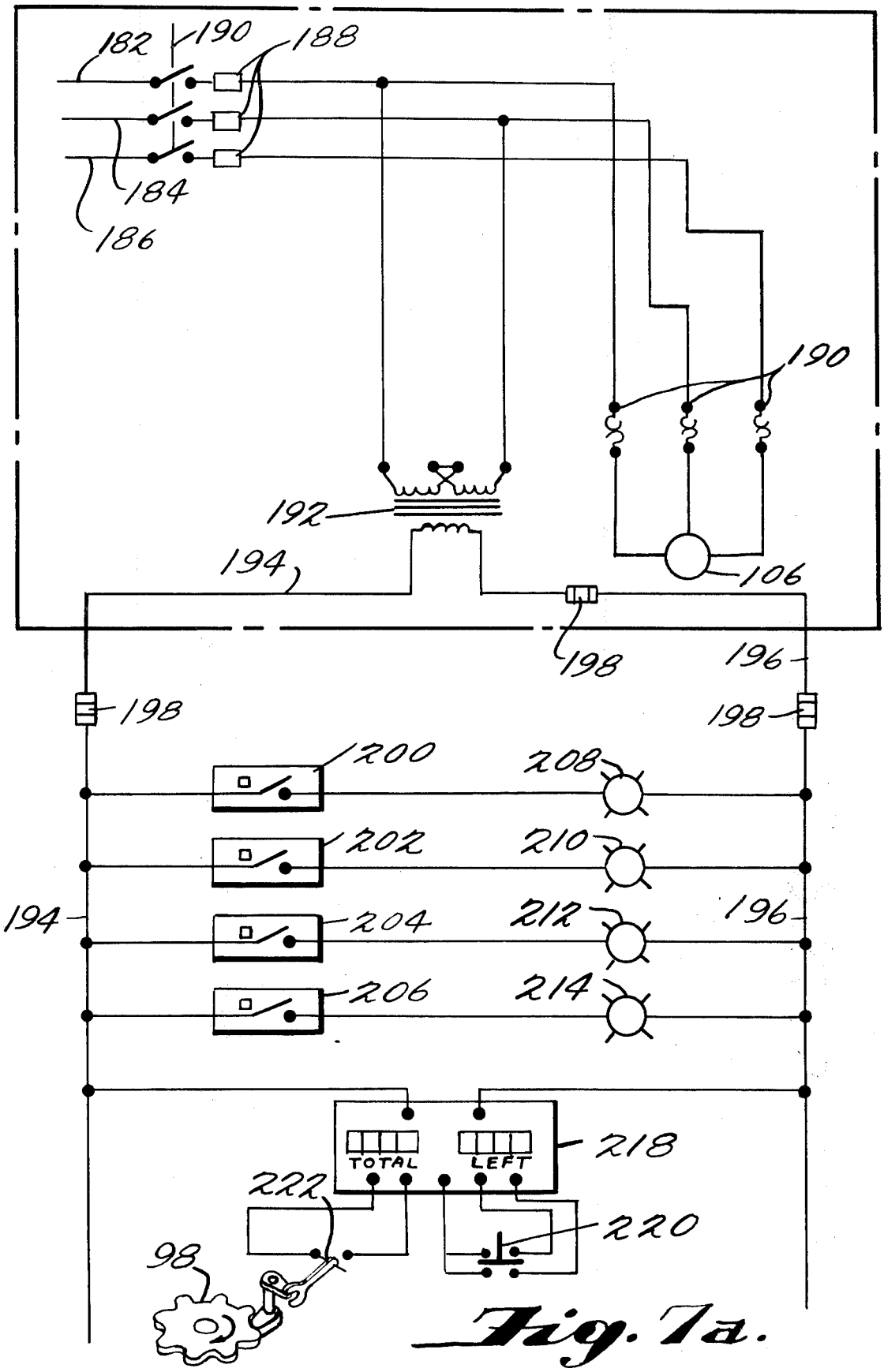
Figure 7B:
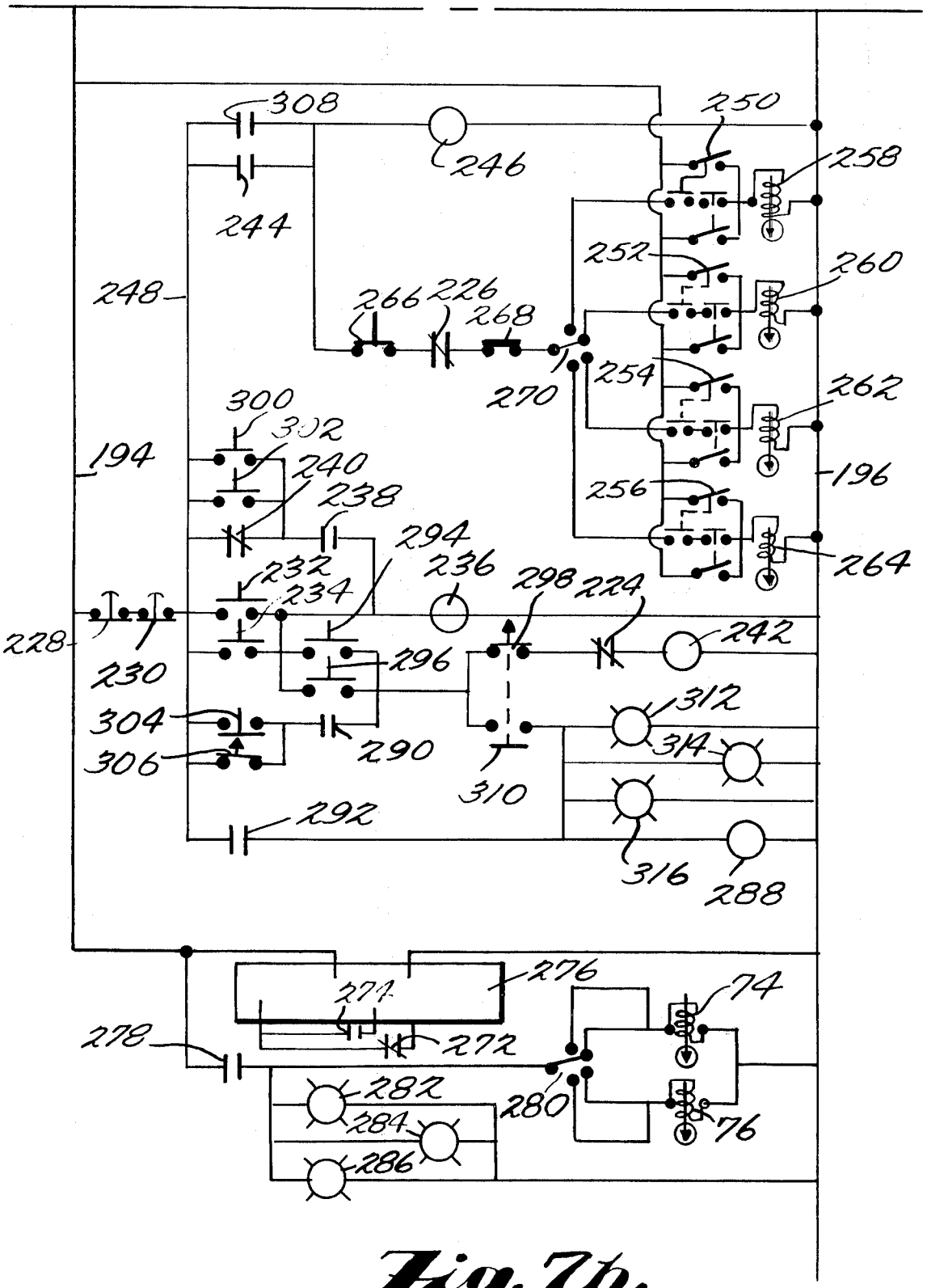

Referring now more particularly to FIGS. 7A and 7B, there is shown therein a control circuit which is utilized in conjunction with the unit 10. The diagram also illustrates components which may be embodied in a remote control panel as will become more apparent as the description proceeds.

As shown in FIG. 7A, the motor 106, which may be a 15 horsepower, 1800 rpm conventional 3-phase 575 volt unit, is provided with three phase current from lines 182, 184 and 186, having suitable fuses 188 and overload release switches 190 provided therein. Suitable 110 voltage for the remainder of the circuit is provided by a transformer 192 feeding to two main lines 194 and 196 having fuses 198 therein. Connected in parallel across the main lines 194 and 196 are four material level detectors 200, 202, 204 and 206 in series with corresponding indicator lights 208, 210, 212 and 214. Each level detector is of any conventional construction, a preferred embodiment being the unit manufactured by Monitor designated as Model No. KAX. The four level detectors 200, 202, 204 and 206 are mounted respectively on supply hoppers 28, 30, 32 and 34. The four lights are mounted on a control panel 216 (see FIG. 1) of the unit 10. Still referring to FIG. 7A, a counter unit 218 is carried on the unit 10 and is connected in parallel across the main lines 194 and 196. The counter unit 218 can be of any construction suitable to provide two output signals. A preferred embodiment is Durant Model No. 29261-704.

The unit 118 provides two numerical readout displays. The first display is capable of being set to a desired number of total counts and always displays the total number of counts set. The second display indicates the cumulative number of counts which are left to make out of the total. This display is initially actuated to read the same as the first counter by pressing a reset button 220. Moreover the display is indexed downwardly in response to the closing of a switch 222.

As the counter unit 218 relates to the present subject matter, each count corresponds with the movement of a pocket 110 filled with granular material moving into the material entraining position and depositing its charge of granular material into the air stream. The switch 222 of the counter unit 218 is arranged so as to be closed in response to a partial rotational movement of the rotor 108 which is equal in degrees to 360 divided by the number of pockets. For example, the rotor 110 and associated mechanisms including the hopper 60, the rotor frame 86, the shaft 96 and stirring assembly 112 can be a conventional unit, as for example, a unit manufactured by National Foundry Sand Company which includes a rotor having eight pockets. As a further illustration of devices of this type see U.S. Pat. No. 2,314,031 the disclosure of which is hereby incorporated by reference into the present application.

In addition to the above, the counter unit 218 has built into it two separate switch contacts illustrated schematically at 224 and 226 in the drawings. The contacts 224 are normally closed and adapted to be opened when the number of counts desired have been made, or until the countdown display goes to zero. The other switch contacts 226 are normally closed but adapted to be opened when the countdown display reaches a predetermined number which can be manually set by the operator. Insofar as the opening of switch 226 is concerned, the number chosen is calibrated to be equal to the number of pockets which must be moved into the material entraining position to clear all of the granular material contained in the hopper 60, the opening 64 and pockets 110 when the associated control gate of the supply hopper being used is closed. This number is reasonably constant for any given material for all speeds. It will vary from material to material only insofar as the angle of repose characterized by the material varies.

As best shown in FIG. 7B, the main stop function of the present system includes a pair of normally closed stop buttons 228 and 230 which are connected in series with each other. Two stop buttons are shown because one is embodied in the control panel 16 while a second is embodied in a remote control panel which is not shown as such in the drawing but which may be moved to any desired position of use. The series connected stop buttons 228 and 230 are connected in series with two parallel normally open air on or initial start push buttons 232 and 234. Here again, two parallel push buttons 232 and 234 are provided so that one may be maintained on control panel 216 while the other is provided on the remote control panel. Finally, the coil of a relay 236 is connected with the push buttons 228, 230, 232 and 234 in series across the main lines 194 and 196 so that the relay coil will be energized when either one of air on push buttons 232 or 234 are actuated. The relay 236 includes a pair of normally open switch contacts 238 which provide a holding circuit for the coil of the relay 236 when either switch 232 or 234 is released. To this end, it will be noted that the switch contacts 238 are connected in a parallel circuit with respect to push buttons 232 and 234. The parallel circuit also includes in series therewith the normally closed switch contacts 240 or a relay 242.

The relay 236 also includes a pair of normally open switch contacts 244 which when the coil of the relay 236 is energized is closed to complete a circuit through the coil of relay 246. In this regard, it will be noted that the circuit is completed between the line 196 and an auxiliary main line 248 connected to the other main line 194 through the normally closed main stop buttons 228 and 230.

The circuitry as illustrated in FIG. 7B provides the operator with the capability of selecting either an automatic operation or manual operation. As a part of the manual operation there is provided a series of four pairs of selector switches 250, 252, 254 and 256. The selector switches are paired so that one of each pair may be mounted on the control panel 216 and one of each pair may be mounted on the remote control panel. Each switch includes two sets of switch contacts one of which is normally open and one of which is normally closed. These sets of switch contacts reverse when the associated selector switch is manually operated. The normally open set of switch contacts of each pair of switches are connected across the main line 194 and 196 in series with the coil of solenoid valve associated with one of the pneumatic piston and cylinder units 58. As shown, there are four solenoid valves designated by the numerals 258, 260, 262 and 264 which are associated respectively with the pneumatic piston and cylinder units 58 of the control gates 48, 50, 52 and 54 respectively controlling the outlet chutes 40, 42, 44 and 46 of the supply hoppers 28, 30, 32 and 34 respectively. It can be seen that when the operator manually actuates any one of the switches 250, 252, 254 or 256 the associated solenoid control valve 258, 260, 262 or 264 will be energized to effect movement of the pneumatic piston and cylinder unit 58 associated with the selected supply hopper 28, 30, 32 or 34. Thus, whenever a selector switch is operated, the associated solenoid valve is energized and the associated control gate is opened to allow the granular material in the selected supply hopper to flow outwardly of the associated discharge chute.

The above manual selector switches are used as a mechanical check of the system and in those situations where special runs are to be made which do not involve predetermined amounts. It is the contemplation of the present invention that the system will be run usually in the automatic mode and in this regard is provided a mode selector switch 266 which is connected in series with the normally open switch contacts 244 of the relay 236. The selector switch is closed when the operator selects automatic operation, completing a circuit from the switch contacts 244 through the normally closed switch contact 226 of the counter unit previously described. In addition the circuit includes a hopper mode selector switch 268 which in normal automatic operation is closed. Finally a hopper selecting switch 270 is included in the circuit and provides for an alternative circuit through the normally closed contacts of the pair of switches 250, 252, 254 and 256 associated with the selected supply hopper as aforesaid.

The hopper mode selector switch 268 enables the operator to utilize the present equipment in an automatic mode in a situation where the supply hoppers have been raised from their normal operative position so that access to the receiving hopper 60 is available to the operator for the purpose of emptying bags of a desired material directly therein.

The relay 246 which is energized when the air on button 232 is engaged includes a set of normally closed switch contacts 272 and a set of normally open switch contacts 274. These switch contacts are connected to control a time delay relay, generally indicated at 276, which is of conventional design, a preferred embodiment being Potter Brumfield Model No. CHB 38-70013. The normally closed switch contacts 272 and the normally open switch contacts 274 are connected with the delay relay 276 so that when they are reversed a pair or normally open switch contacts 278 forming a part of the relay 276 will serve to energize one or the other of the pair of solenoid valves 74 and 76 depending upon the position of a selector switch 280 connected in series therewith. When switch contacts 272 and 274 are returned to their normal positions switch contacts 278 remain closed for a predetermined time and then rivert to the normally open position.

It can be seen that when either of the start buttons 232 or 234 are engaged the energization of the coil of relay 246 will have the effect of closing the switch contacts 278 or the delay relay 276 to complete the circuit through either the solenoid valve 74 or the solenoid valve 76 depending upon the position of selector switch 280. The closing of switch contact 278 is signalled by three lights 282, 284 and 286. In this case the three lights are provided so that one can be mounted on the control panel 216, a second can be mounted on the remote control panel and a third can be mounted in a position to be seen by the operator at the furnace.

The circuit also includes functions capable of turning on the motor 106 for rotating the pocketed rotor but only if the air on button circuit has already been energized. In this regard the motor 106 is provided with a starter of the type which includes a starter coil 288, which, when energized, closes a normally open pair of switch contacts 290. The energization of the starter coil 288 is controlled by relay 242 by a series circuit across lines 248 and 196 which includes the starter coil 288 and providing a normally open pair of switch contacts 292 of the relay 242. The energization of the coil of relay 242 is under the control of either one of a pair of parallel push buttons 294 and 296 which are mounted respectively on the control panel 216 and remote control panel. The push buttons 294 and 296 are connected in the holding circuit of the relay 236 which includes the normally open switch contacts 238 thereof and the normally closed switch contacts 240 of the relay 242. Consequently the closing of the "material on" starting switch will not serve to energize the coil of the relay 242 unless the "air on" starter button 232 has been previously enegaged to energize the coil of relay 236. The switches 294 and 296 are connected with the coil of the relay 242 through a pair of switch contacts 298 which are closed when selector switch 266 is moved to its automatic mode position and the normally closed switch contacts 224 of the counter unit 218.

To insure that the circuit through the holding circuit of the relay 236 will be available for a time sufficient to start the motor 106, each of the push buttons 294 and 296 includes an additional pair of switch contacts 300 and 302 which are connected in parallel across the normally closed pair of switch contacts 240 of the relay 242. This insures that so long as the push buttons 294 and 296 are engaged relay 242 will be energized to complete the circuit through the closed switch contact 292 and the starter coil 288. Once the motor 106 has been started switch contact 290 is closed to maintain the circuit to the coil of the relay 242 through this set of closed contacts which are in series with either a normally closed manual "material off" push button 304 or a pair of switch contacts 306 which are closed when the automatic mode selector switch 266 is in its automatic position.

It will be noted, however, that in conjunction with the energization of the coil of the relay 242 the normally closed switch contacts 240 thereof will be opened so that as soon as the operator releases the "material on" button 294 or 296, the holding circuit for the relay 236 is opened. Since the energization of relay 246 controlling the air on function is initially responsive to the energization of the relay 236 through switch contacts 244, the continued energization of the relay 246 is maintained by the relay 242 when the relay 236 is turned off as aforesaid. To this end, it will be noted that the relay 242 includes a pair of normally open switch contacts 308 which are connected in parallel with the normally open switch contacts 244. It can thus be seen that when the mode selector switch 266 is in its automatic mode position as shown, the relay 242 serves to control both the energization of the motor 106 which feeds the material into the air stream and the flow of air in the air stream through relay 246 and time delay relay 276. The circuit to the relay 242 is opened in response to the opening of the zero switch contacts 224 of the counter unit 218. Once relay 242 is turned off, the circuit for the motor 106 is deenergized and relay 246 is deenergized which in turn causes time delay relay 276 to go through its timed sequence after which switch contacts 278 are opened to close the selected solenoid valve 74 or 76.

It will also be noted that part of the automatic operation is for switch contacts 226 of the counter unit 218 to open at a predetermined number of counts before the total number of counts is reached to open switch contacts 224. The prior opening of the switch contacts 226 serves to deenergize the solenoid valve associated with the selected supply hopper causing the piston and cylinder unit 58 associated therewith to close the gate associated with the selected supply hopper.

The provision of selector switch 250, 252, 254 and 256 for the purpose of providing alternate manual operation of the control gates of the supply hoppers has already been described. The provision of the hopper mode selector switch 268 enables the operator to choose the automatic mode of operation insofar as the mode selector switch 266 is concerned, but to isolate from the automatic operation the gate closing function under the control of the switch contacts 226. In this regard it will be noted that opening of the selector switch 268 interrupts the circuit provided by the switch contacts 226 to the selected solenoid valve 258, 260, 262 or 264. The operator must then select the desired solenoid valve to be actuated by actuating the associated selector switch 250, 252, 254 or 256.

When the mode selector switch 266 is moved to its manual position, switch contacts 266 are opened which has the same effect as opening hopper mode selector switch 268. In addition, switch contacts 298 and 306 are opened and a fourth set of switch contacts 310 are closed. When the switch contacts 298 are opened, the circuit provided through zero switch contacts 224 and relay 242 are opened so that all of the functions previously provided by relay 242 are no longer utilized in the manual mode of operation. Thus, instead of energizing the motor starter coil 288 through switch contacts from the relay 242, the circuit is directly connected to the coil 288 through the closed switch contacts 310 of the mode selector switch. It will be noted that the "air on" buttons 232 and 234 still have the effect of energizing relay 236 and that the normally closed switch contacts 240 enter into the holding circuit for the relay 236. "Material on" buttons 294 and 296 when engaged will directly complete the circuit to the motor coil 288 and as soon as the motor is started switch contacts 290 will close maintaining the circuit through the normally closed "material off" push button 304 even though switch contacts 306 are open.

In order to indicate that the material feeding motor 106 is on a manual mode of operation, there are provided three lights, 312, 314 and 316 which are positioned alongside the lights 282, 284 and 286. It will be noted that once the motor has been started, the motor will continue to operate with the lights 312, 314 and 316 so indicating by being turned on until the operator pushes the "material off" button 304. In the manual mode of operation, stop buttons 228 and 230 are used to close the selected solenoid valves 74 or 76. It will be noted that when either one of the stop buttons 228 or 230 is engaged the open switch contacts of the stop button serve to open the circuit to the relays 236 and 246. Time delay relay 276 is thus activated through its timed delay cycle to open the switch contacts 278 in the same manner as previously described. In this regard it will also be noted that stop buttons 228 and 230 can serve an emergency stop function for the entire circuit no matter what mode of operation is selected in which case the air valves are always closed a predetermined time after the motor 106 feeding the material to the air circuit has been stopped.

OPERATION

In the operation of the present invention, the supply hoppers 28, 30, 32 and 34 are filled with granular material to be injected in the body of molten metal in the furnace. The materials which can be selected from the supply hoppers are commercially available and are in a granular form which is free flowing. Examples of materials which may be selected include, graphite for carbon increase, as for example the product sold by the G-O-C Company under the trademark GRAPH-O-CARB which is a highly graphitic carbon plus volatiles plus utectic ash and sized (20 × 200 mesh). Another material used for carbon decrease is $Fe_3O_4$ an example of which is marketed by the G-O-C Company under the trademark De-O-CARB. A third classification of materials are various metal oxides for use in providing alloy characteristics to the steel as for example, nickel oxide and manganese oxide which are marketed by the G-O-C Company under the trademarks NIC-O-CARB and MAN-O-CARB. Lime is another material which may be injected for purposes of slag control. Sulphur is another material which may be injected for purposes of desulphurization, an example of which is marketed by the G-O-C Company under the trademark De-SULFO-CARB.

As will be appreciated the density and other physical characteristics of the material will determine the speed at which the unit 100 is operated as well as which of the pressure regulators 78 or 80 will be utilized to determine the air pressure at which injection is accomplished. For example, the high pressure regulator is utilized during the injection of oxides whereas the other lower pressure regulator is utilized during the injection of graphite for carbon increase. An exemplary setting for the high pressure regulators is 50. p.s.i. and an exemplary setting for the low pressure regulator is 30. p.s.i. In this regard it is contemplated for any given system that the selector switch 280 for the air pressure valve instead of constituting a separate switch from the selector switch 270 for the supply hoppers may be simply a second set of switch contacts wired so as to provide the proper air pressure for a selected supply hopper. In this way the operator need make only one selection namely, that of the material which is within the supply hopper and the movement of the selector switch 270 to the desired material will automatically have the effect of selecting the proper air pressure for that material.

It will be understood that while four supply hoppers are shown, more than four or less than four may be provided. It will also be noted that with the frame arrangement described, the supply hoppers may be lifted by the hook 26 and retained in an upwardly spaced position enabling the operator to utilize the other components of the machine by dumping a material directly into the supply hopper 60 should the occasion demand.

Once the supply hoppers have been filled, the operator first selects the specific material which is to be injected, as aforesaid, and then selects the amount of the selected material to be injected. This is done by setting the readout display of the counter unit 218 to indicate the total counts desired and then pushing the push button 220 to register the same total at the other readout display. Having selected the desired material and amount thereof to be injected and having set the mode selector switch 266 in its automatic position, the operator then sets the tip of the lance 118 on the lip of the furnace. In this regard it will be noted that the lance can be easily handled by the operator by virtue of the wheeled carriage assembly 120. Next, the operator pushes the "air on" button 232 which has the effect of opening the appropriate air valve 74 or 76 whichever has been previously selected. When this function has been achieved, light 282 will come on. The lance carriage assembly 120 is now moved forward about five feet which inserts the lance 118 into the molten metal bath. Next, the operator pushes the "material on" button 294 which commences the automatic operation of the material feed.

The system will now proceed to effect injection and when a predetermined number of counts are left to be made, the counter unit 218 sends out a signal by opening switch contacts 226 which has the effect of closing the control gate of the selected supply hopper. Injection automatically continues until the number of counts reaches zero at which time all of the material which has been fed from the supply hopper will have passed through the system into the molten metal bath, as aforesaid. The automatic circuit at that point first cuts off the motor 106 which drives the pocketed rotor and then after an appropriate time delay closes the selected valve. As soon as the light 282 goes out the operator removes the lance. It will be understood that since the lance is used up by virtue of the amount of time in which it is maintained in the molten metal it is important to provide the light turn-off signal to the operator as soon as possible after the system has been cleared.

What is claimed is:

1. Apparatus for injecting a predetermined amount of a free flowing granular material into a body of molten metal or the like comprising:

a supply hopper for receiving a supply of granular material, said supply hopper having discharge opening means therein, means for controlling the flow of granular material received within said supply hopper outwardly through said discharge opening means, means for receiving the granular material flowing outwardly from the discharge opening means of said supply hopper under the control of said control means and feeding the same to an incremental volume forming position, means defining a confined flow path for the flow of air under pressure into a granular material entraining position and for the flow of air under pressure with granular material entrained therein from said granular material entraining position to a discharge end, the discharge end of said flow path defining means comprising a lance for the body of molten metal, valve means in said confined flow path upstream of said granular material entraining position for controlling the flow of air under pressure through said confined flow path, power operated means for transferring successive incremental volumes of granular material from said incremental volume forming position to said granular material entraining position, and means for sensing a condition indicative of the flow of a predetermined amount of granular material through the discharge opening means of said supply hopper and for (1) operating said control means to prevent further flow of material through the discharge opening means of said supply hopper and (2) rendering said power driven means inoperable and closing said valve means after the operation of said control means so as to insure that all of the granular material received from the discharge opening means of the supply hopper prior to the operation of said control means is fed to said incremental volume forming position, transferred to said granular material entraining position, entrained within the air under pressure flowing in said confined path and discharged therewith through said lance into the body of molten metal.

2. Apparatus as defined in claim 1 wherein said power driven means includes a rotor having a series of pockets formed therein in positions such that successive pockets are moved from said incremental volume forming position wherein they are filled with granular material to said material entraining position wherein they are emptied of the granular material filled therein in response to the rotation of said rotor, and variable speed power means drivingly connected with said rotor.

3. Apparatus as defined in claim 2, wherein said sensing means comrises a counter for counting the number of successive filled pockets moved from said incremental volume forming position to said granular material entraining position, the condition indicative of the flow of a predetermined amount of granular material through said discharge opening means constituting the total number of successive pockets which when filled equals said predetermined amount less the number of successive pockets corresponding to an amount calibrated on the basis of the amount contained within said receiving means and pockets immediately following the operation of said control means.

4. Apparatus as defined in claim 1, wherein said supply hopper includes a discharge chute having its lower end open to define said discharge opening means, said control means comprising gate means pivotally mounted on said discharge chute for movement between a closed position blocking the flow of material from the open lower end of the chute and an open end position displaced from said opening and power operated means for moving said gate means between said closed and open positions.

5. Apparatus as defined in claim 1 wherein said receiving and feeding means comprises a hopper having power driven rotatable stirring means therein.

6. Apparatus as defined in claim 1 wherein said last mentioned means includes time delay means for insuring that said valve means is never closed until after said power driven means has been rendered inoperable a predetermined time.

7. Apparatus as defined in claim 1 wherein said power driven means is provided with interlock control means for preventing the commencement of the operation thereof when said valve means is closed.

8. Apparatus as defined in claim 1 wherein said confined flow path defining means includes at a position upstream of said valve means filter means for removing all moisture in the source of air under pressure.

9. Apparatus as defined in claim 1 wherein said confined flow path defining means includes pressure regulator means between said filter means and said valve means and a second alternative flow path portion parallel with the portion containing said valve means and said pressure regulator means having second valve means therein and second pressure regulator means upstream thereof which operates at a pressure different from said first mentioned pressure regulator means.

10. Apparatus as defined in claim 1 wherein said receiving and feeding means and said power operated means are carried on a common base frame, a telescoping frame disposed above said base frame having hook means thereon for enabling an overhead crane to lift and lower the same into different positions of telescopic movement with respect to said base frame, means for supporting said telescoping frame in different positions of telescopic movement with respect to said base frame, said telescoping frame supporting said supply hopper and the control means associated therewith.

11. Apparatus as defined in claim 1 wherein said lance has wheeled carriage means supporting the same, said wheeled carriage including a carriage frame, wheel means supporting said carriage frame for movement along a horizontal surface, floor lock means for selectively stabilizing the carriage frame against movement supported by said wheel means, and means carried by said carriage means for adjustably supporting said lance thereon.

12. Apparatus as defined in claim 11 wherein said lance supporting means includes an upstanding tube fixed to said carriage frame, an inner tubular member telescopically mounted within said tube means for supporting said inner tubular member in different positions of telescopic movement within said tube, clamping means for releasably gripping the periphery of said lance, and a ball and socket joint between said clamping means and the upper end of said inner tubular member.

13. Apparatus for injecting a predetermined amount of a selected free flowing granular material into a body of molten metal of the like comprising:

a plurality of supply hoppers for receiving a plurality of supplies of different granular material to be selected for injection, each of said supply hoppers having discharge opening means therein, means for controlling the flow of granular material received within any selected one of said supply hoppers outwardly through the discharge opening means thereof, means for receiving the granular material flowing outwardly from the discharge opening means of the selected supply hopper under the control of the control means thereof and feeding the same to an incremental volume forming position, means defining a confined flow path for the flow of air under pressure into a granular material entraining position and for the flow of air under pressure with granular material entrained therein from said granular material entraining position to a discharge end, the discharge end of said flow path defining means comprising a lance for the body of molten metal, valve means in said confined flow path upstream of said granular material entraining position for controlling the flow of air under pressure through said confined flow path, power operated means for transferring successive incremental volumes of granular material from said incremental volume forming position to said granular material entraining position, and means for sensing a condition indicative of the flow of a predetermined amount of granular material through the discharge opening means of said supply hopper and for (1) operating said control means to prevent further flow of material through the discharge opening means of said supply hopper and (2) rendering said power driven means inoperable and closing said valve means after the operation of said control means so as to insure that all of the granular material received from the discharge opening means of the supply hopper prior to the operation of said control means is fed to said incremental volume forming position, transferred to said granular material entraining position, entrained within the air under pressure flowing in said confined path and discharged therewith through said lance into the body of molten metal.

14. Apparatus as defined in claim 13 wherein said last mentioned means includes time delay means for insuring that said valve means is never closed until after said power drived means has been rendered inoperable a predetermined time.

15. Apparatus as defined in claim 14 wherein said power driven means is provided with interlock control means for preventing the commencement of the operation thereof when said valve means is closed.

16. Apparatus as defined in claim 15 wherein said confined flow path defining means includes at a position upstream of said valve means filter means for removing all moisture in the source of air under pressure.

17. Apparatus as defined in claim 16 wherein said confined flow path defining means includes pressure regulator means between said filter means and said valve means and a second alternative flow path portion parallel with the portion containing said valve means and said pressure regulator means having second valve means therein and second pressure regulator means upstream thereof which operates at a pressure different from said first mentioned pressure regulator means.

18. Apparatus as defined in claim 17 wherein said power driven means includes a rotor having a series of pockets formed therein in positions such that successive pockets are moved from said incremental volume forming position wherein they are filled with granular material to said material entraining position wherein they are emptied of the granular material filled therein in response to the rotation of said rotor, and variable speed power means drivingly connected with said rotor.

19. Apparatus as defined in claim 18 wherein said sensing means comprises a counter for counting the number of successive filled pockets moved from said incremental volume forming position to said granular material entraining position, the condition indicative of the flow of a predetermined amount of granular material through said discharge opening means constituting the total number of successive pockets which when filled equals said predetermined amount less the number of successive pockets corresponding to an amount calibrated on the basis of the amount contained within said receiving means and pockets immediately following the operation of said control means.

20. Apparatus as defined in claim 19 wherein each of said supply hoppers include a discharge chute having its lower end open to define said discharge opening means thereof the control means for each supply hopper comprising gate means pivotally mounted on said discharge chute thereof for movement between a closed position blocking the flow of material from the open lower end of the chute and an open position displaced from said open end and power operated means for moving said gate means between said closed and open positions.

21. Apparatus as defined in claim 20 wherein said receiving and feeding means comprises a hopper having power driven rotatable stirring means therein.

22. Apparatus as defined in claim 13 wherein said receiving and feeding means and said power operated means are carried on a common base frame, a telescoping frame disposed above said base frame having hook means thereon for enabling an overhead crane to lift and lower the same into different positions of telescopic movement with respect to said base frame, means for supporting said telescoping frame in different positions of telescopic movement with respect to said base frame, said telescoping frame supporting said supply hoppers and the control means associated therewith.

23. Apparatus as defined in claim 13 wherein said lance has wheeled carriage means supporting the same, said wheeled carriage including a carriage frame, wheel means supporting said carriage frame for movement along a horizontal surface, floor lock means for selectively stabilizing the carriage frame against movement supported by said wheel means, and means carried by said carriage means for adjustably supporting said lance thereon.

24. Apparatus as defined in claim 23 wherein said lance supporting means includes an upstanding tube fixed to said carriage frame, an inner tubular member telescopically mounted within said tube, means for supporting said inner tubular member in different positions of telescopic movement within said tube, clamping means for releasably gripping the periphery of said lance, and a ball and socket joint between said clamping means and the upper end of said inner tubular member.

25. A lance assembly for use in injecting a predetermined amount of a free flowing granular material into a body of molten metal or the like comprising:

a lance in the form of an elongated pipe, wheeled carriage means for supporting said lance, said wheeled carriage including a carriage frame, wheel means supporting said carriage frame for movement along a horizontal surface, floor lock means for selectively stabilizing the carriage frame against movement supported by said wheel means, and means carried by said carriage means for adjustably supporting said lance thereon, said lance supporting means including upstanding tube fixed to said carriage frame, an inner tubular member telescopically mounted within said tube, means for supporting said inner tubular member in different positions of telescopic movement within said tube, clamping means for releasably gripping the periphery of said lance, and a ball and socket joint between said clamping means and the upper end of said inner tubular member.

* * * * *